United States Patent [19]

Asao et al.

[11] Patent Number: 4,481,895

[45] Date of Patent: Nov. 13, 1984

[54] PIPING SEWING DEVICE

[75] Inventors: Hideo Asao, Mitaka; Satoru Yasuda, Tokyo, both of Japan

[73] Assignee: Tokyo Juki Industrial Co., Ltd., Japan

[21] Appl. No.: 373,671

[22] Filed: Apr. 30, 1982

[30] Foreign Application Priority Data

May 9, 1981 [JP] Japan ..... 56-69897

[51] Int. Cl.[3] ..... D05B 21/00

[52] U.S. Cl. ..... 112/121.12; 112/311; 112/67; 112/68

[58] Field of Search ..... 112/121.12, 121.11, 112/121.15, 311, 315, 2, 65, 67, 68, 70

[56] References Cited

U.S. PATENT DOCUMENTS

| | | | |
|---|---|---|---|
| 3,763,802 | 10/1973 | Champney et al. | 112/311 X |
| 4,069,778 | 1/1978 | Kozawa | 112/121.12 |
| 4,135,459 | 1/1979 | Manabe et al. | 112/121.12 |
| 4,341,169 | 7/1982 | Mainot et al. | 112/121.12 |

*Primary Examiner*—Peter Nerbun
*Attorney, Agent, or Firm*—Parkhurst & Oliff

[57] ABSTRACT

The invention relates to a sewing device which includes a sewing machine fixedly provided on a horizontal top surface of a bench, a fabric transfer mechanism for holding and making a fabric movable on the tip surface of the bench between a first position and a second position with a machine sewing portion being interposed therebetween and a pulse motor interlocked with the fabric transfer mechanism to move the mechanism. The machine sewing is performed during the movement of the fabric transfer mechanism from the first position to the second position. The device further includes a memory portion for storing length data of a plurality of seam lines to be stitched on the fabrics, the seam lines being different in length from one another. The device also includes a controller storing instruction data for driving a pulse motor by pulse numbers necessary for reciprocating the fabric transfer mechanism between the first and the second positions, repeating the length data of the memory portion based on the order data in association with the movement of the fabric transfer mechanism from the second position to the first position, and driving and stopping the sewing machine during a time period suitable for forming the seam lines in accordance with the length data during the movement of the fabric transfer mechanism from the first position to the second position.

1 Claim, 13 Drawing Figures

| FIG.8A | FIG.8B |
|---|---|

FIG.10

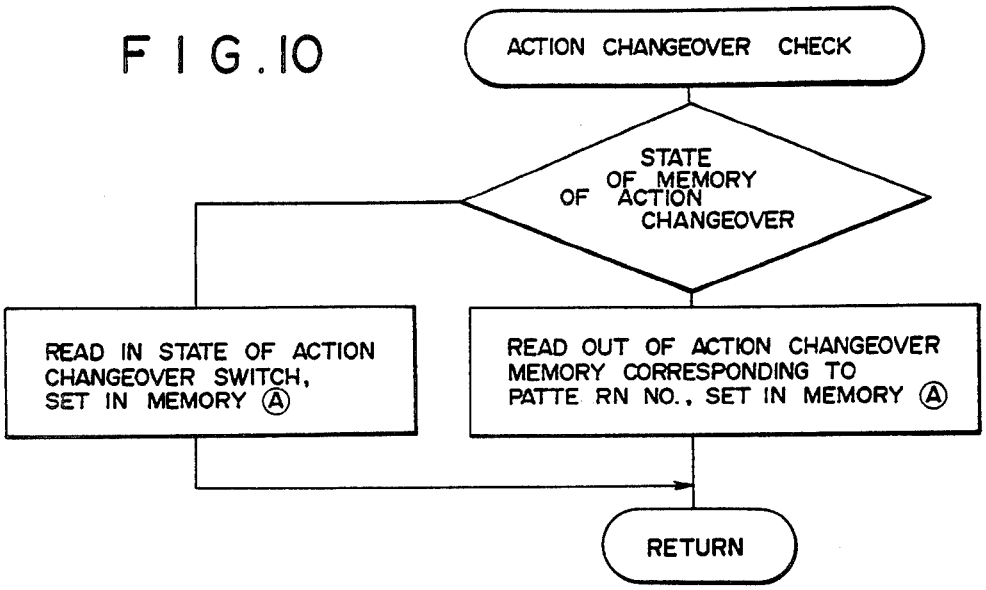

FIG.11

| | | |
|---|---|---|
| 0 | SEWING LENGTH INSTRUCTED | SINGLE MODE |
| 1 | SEWING LENGTH INSTRUCTED | SINGLE MODE |
| 2 | SEWING LENGTH INSTRUCTED | SINGLE MODE |
| 3 | SEWING LENGTH INSTRUCTED | SINGLE MODE |
| 4 | SEWING LENGTH INSTRUCTED | CONTINUOUS MODE |
| 5 | SEWING LENGTH INSTRUCTED | CONTINUOUS MODE |
| 6 | SEWING LENGTH INSTRUCTED | CONTINUOUS MODE |
| 7 | SEWING LENGTH INSTRUCTED | CONTINUOUS MODE |
| 8 | SEWING LENGTH INSTRUCTED | CONTINUOUS MODE |
| 9 | SEWING LENGTH DETERMIND BY LIGHT SENSOR | SINGLE MODE |

PIPING SEWING DEVICE

BACKGROUND OF THE INVENTION

This invention relates to a sewing device, wherein fabrics are transferred by a fabric transfer mechanism along the surface of a machine table from a first position to a second position with a machine sewing portion being interposed therebetween. During the transfer, machine sewing is effected to form seam lines of predetermined lengths on the fabrics as in a piping sewing device or a darts sewing device. More particularly the present invention relates to a sewing device wherein memory means is provided for storing length data of a plurality of seam lines to be stitched on the fabrics and order data for instructing the order of reading out the aforesaid length data. Each time the fabric transfer mechanism returns to the second position or the first position the length data is repeatedly renewed one after another in accordance with the order data, and, during the movement of the fabric transfer mechanism from the first position to the second position, a sewing machine is driven and stopped during a time period suitable for forming the seam lines in accordance with the length data thereof.

Heretofore, there has been developed a piping sewing device filed by the present applicant, in which nine types of pattern numbers and sewing lengths are desirably selected in advance and made it possible to be inputted into a microcomputer. Out of all these pattern numbers, one pattern number is selected to control the sewing machine in its start and stop, so that a seam line having a length corresponding to the pattern number selected can be formed during the movement of the fabric transfer mechanism from the first position to the second position. In using this piping sewing device, either one of the following methods must be selected when the device is applied to a material such as a sack coat, in which a plurality of pipings (pockets) different in length from one another are formed in a body material. Namely, the methods include a first method, in which, in one body material piece, each time one piping is formed, the body material piece is removed from the fabric transfer mechanism, the succeeding body material piece is set, and thus for all of the body material pieces, a common piping is stitched. Thereafter, another pattern number is selected again and a piping having a length corresponding to the pattern number is sewn with all of the body material pieces, and, thus the above-described operation is repeated as many times as the types of the piping. In the second method each time one piping is sewn, the pattern number is reselected. In the case of the former, it is necessary to perform the removing from and mounting onto the fabric transfer mechanism of the fabric as many times as the number of the pipings. In both cases, there have been presented the disadvantages that operation is troublesome and the working efficiency of sewing cannot by improved.

SUMMARY OF THE INVENTION

The present invention has been developed to obviate the above-described disadvantages of the prior art and has as its object the provision of a sewing device, wherein length data of a plurality of seam lines different in length from one another and order data for instructing the order of reading out the length data in plural number are stored in advance in a microcomputer and the plurality of seam lines different in length from one another are repeatedly sewn in accordance with the orders.

The present invention can provide a sewing device, wherein the device comprises a sewing machine fixedly provided on a horizontal top surface of a bench, a fabric transfer mechanism for holding and making a fabrics movable on the top surface of the bench between a first position and a second position with a machine sewing portion being interposed therebetween and a pulse motor interlocked with the fabric transfer mechanism to move the mechanism. The machine sewing is performed during the movement of the fabric transfer mechanism from the first position to the second position. The device further includes memory means for storing length data of a plurality of seam lines to be stitched on the fabrics, the seam lines being different in length from one another, and a controller storing instruction data for driving a pulse motor by pulse numbers necessary for reciprocating the fabric transfer mechanism between the first and the second positions, repeating the length data of the memory means based on the order data in association with the movement of the fabric transfer mechanism from the second position to the first position, and driving and stopping the sewing machine during a time period suitable for forming the seam lines in accordance with the length data during the movement of the fabric transfer mechanism from the first position to the second position.

The present invention is of the arrangement that the sewing device has the memory means and the controller, the length data stored in the memory means is repeatedly renewed one after another in accordance with the order data in association with the return of the fabric transfer mechanism from the second position to the first position, and the sewing machine is driven and stopped during the time period suitable for forming the seam lines in accordance with the length data during the movement of the fabric transfer mechanism from the first position to the second position. In consequence, such troublesome operations that the length of a seam line is reselected each time one seam line is stitched or the material is reset as required in the prior art can be dispensed with. A mere start operation of the sewing device makes it possible that all of the pockets of the set body material are sewn up, whereby the working efficiency of sewing is improved to a considerable extent. Once sewing lengths are accurately set, resetting is not required to do as far as products of the same type are sewn, so that a possibility of mistaken setting of sewing lengths can be eliminated as seen in the sewing machines of the prior art, in which, each time one seam line is stitched, resetting is required, thereby enabling to obtain products having uniform lengths of seam required and high value as a commodity.

BRIEF DESCRIPTION OF THE ACCOMPANYING DRAWINGS

FIGS. 8, 8A, 8B, 9 and 10 are flow charts showing respective portions of FIG. 7; and FIG. 11 shows another embodiment.

DESCRIPTION OF THE PREFERRED EMBODIMENTS

Figure 3:
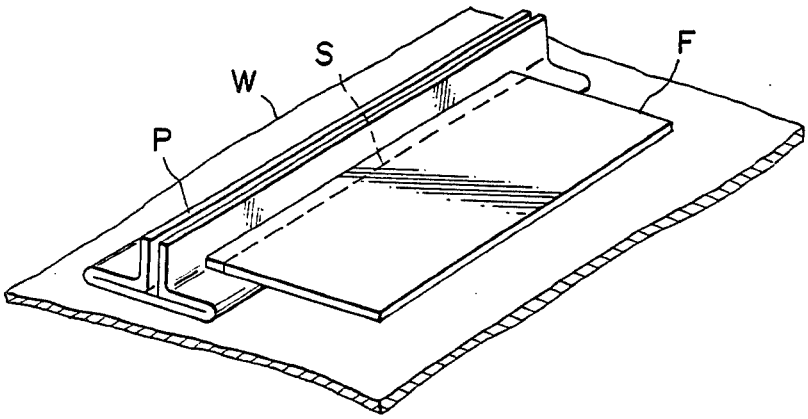
FIG. 3 is a perspective view showing a sewn up state of the body material, piping fabric and flap fabric.

Description will hereunder be given of the present invention with reference to the accompanying drawings. As shown in FIG. 3, the illustrated embodiment relates to a piping sewing device, wherein a piping fabric P is folded and overlapped in an inverted T-shape on an article to be sewn W constituting a wearing material. Further, a flap fabric F is overlapped on the piping fabric P, and thereafter, these fabrics are transferred from the first position to the second position, the both positions interposing the machine sewing portion therebetween. Two lines of machine sewings S are conducted at positions inwardly of opposite folded portions of the piping fabric P during the aforesaid transfer. These fabrics are sewn up together and a pocket hole is cut open between the aforesaid two seam lines S by means of a knife operable in synchronism with a sewing mechanism, and finally, wedge-like cutins are formed at opposite ends of the pocket hole by means of corner knives.

(I) Regarding a mechanical section

Figure 1:
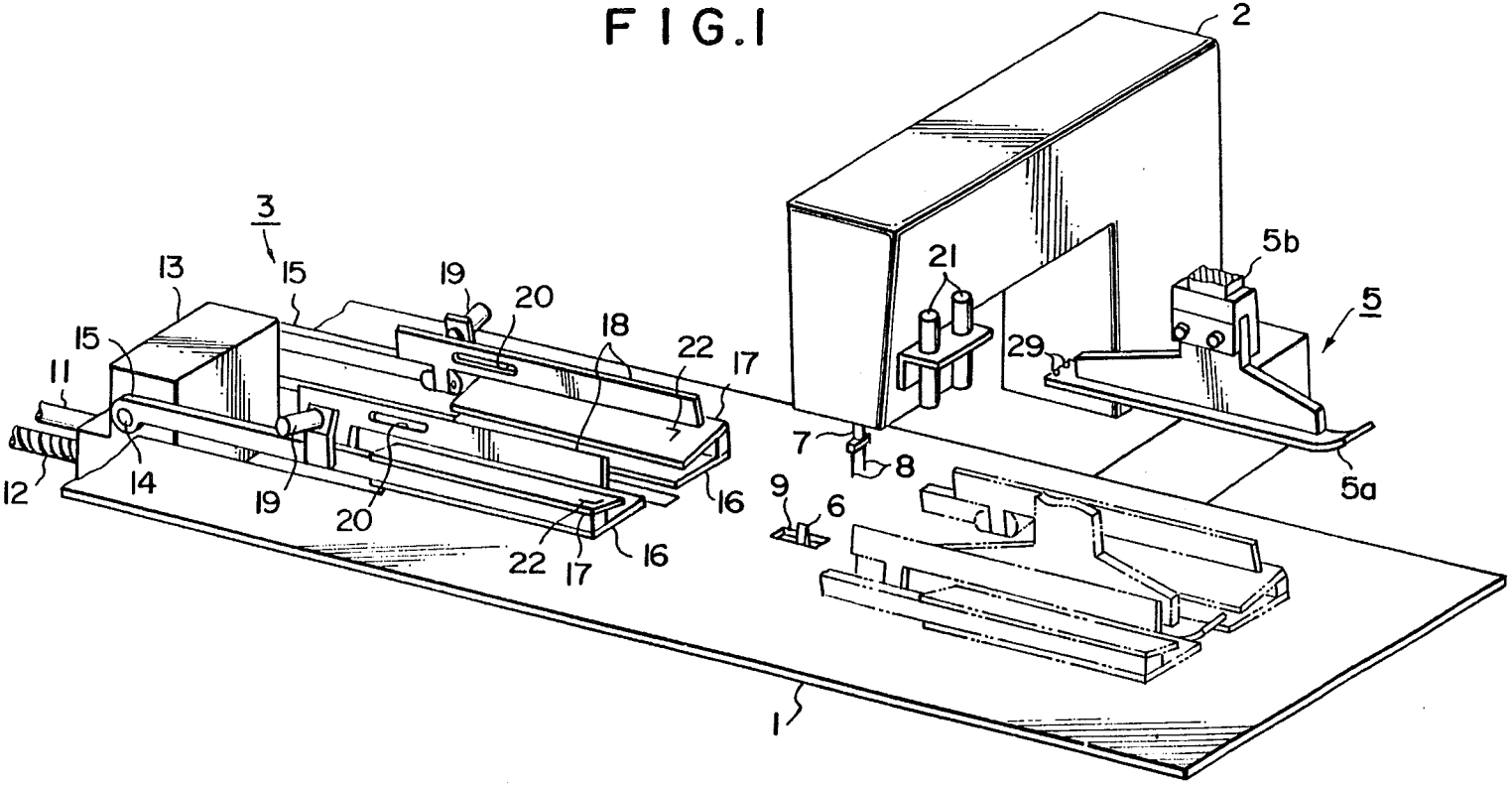
FIG. 1 is a perspective view, partially omitted, of this sewing device.
Figure 2:
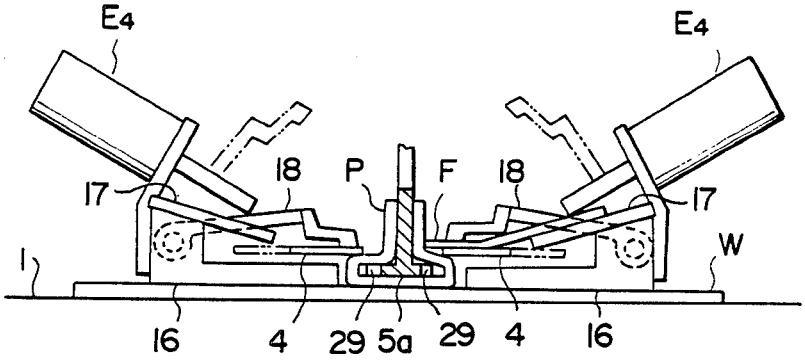
FIG. 2 is a sectional view showing the conditions of cooperations of the fabric transfer mechanism and a folding mechanism.
Figure 6:
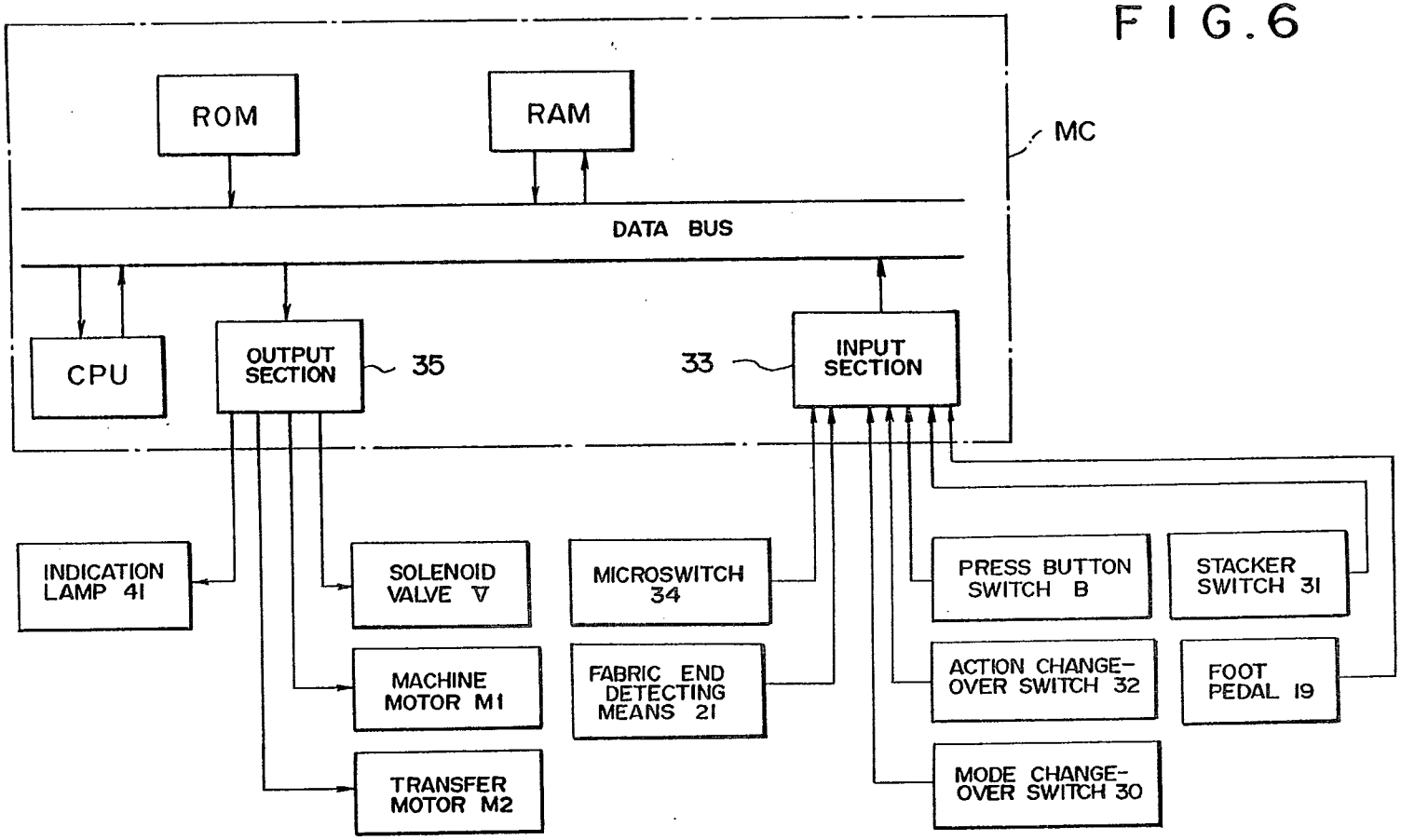
FIG. 6 is a block diagram of the control circuit.

The mechanical section comprises:

a sewing machine 2 disposed at the intermediate portion on a bench 1;

a fabric transfer mechanism 3 for transferring a wearing material W, a piping fabric P and a flap fabric F along the top surface of the bench 1 from a first position indicated by two-dot chain lines in FIG. 1 to a second position indicated by solid lines in FIG. 1, the both positions interposing the sew-up point of a sewing machine 2 (the distance between the two positions being 345 mm);

a folding mechanism 5 having a fabric presser foot 5*a* for folding and overlapping the piping fabric P on the wearing material W into an inverted T-shape in cooperation with piping fabric pressers 4 and 4 (Refer to FIG. 2);

a center knife mechanism 6 for cutting open a pocket hole, not shown, between two seam lines S stitched during the aforesaid transfer effected by the fabric transfer mechanism 3;

a corner knife mechanism, not shown, for forming wedge-like cutins at opposite ends of the pocket hole when the wearing material W is transferred to the second position;

a stacker for taking out of the fabric transfer mechanism 3 and stacking on a heaping bed the wearing materials after being sewn one after another; and a controller for controlling the respective mechanisms and the sewing machine in the predetermined order (Refer to FIG. 6).

Figure 4:
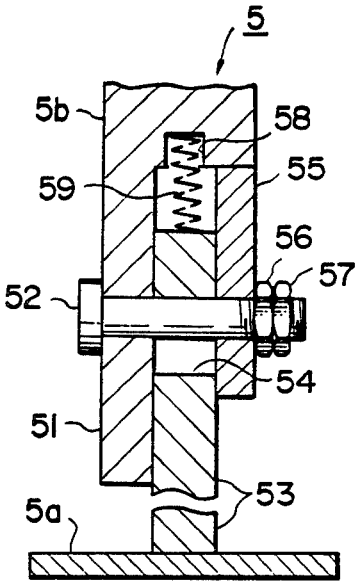
FIG. 4 is a sectional view showing the state of supporting a fabric presser foot against a base.

The sewing machine 2 is a well known two needle chain stitch machine provided at the lower end of a needle bar 7 thereof with two needles 8 and operationally associated with a machine motor M1 (Refer to FIG. 6). A slit 9 disposed in parallel to a direction of transferring the fabrics (to the left in FIG. 1) is vertically penetratingly formed in the bench 1 between two needle holes, and, within this slit 9, the aforesaid knife 6 for cutting open the pocket hole in the wearing material W and the piping fabric P in operational association with an actuating mechanism in a machine bed is provided in a manner to be able to appear from or disappear into the top surface of a throat plate in synchronism with the needle bar 7. The folding mechanism 5, as shown in FIGS. 1 and 4, comprises the aforesaid fabric presser foot 5*a* and a lifting member 5*b*, not shown in detail, made vertically movable with a predetermined stroke through the action of an air cylinder E2 not shown. Vertically elongated slot 54 formed in a vertical leg 53 of the fabric presser foot 5*a* is loosely coupled onto a pivot 52 horizontally supported on a guide portion 51 vertically, downwardly suspended from on one side of the lower end of the lifting member 5*b*, so that the fabric presser foot 5*a* can be vertically movable relative to the lifting member 5*b*. A guide plate 55 is supported on the pivot 52, whereby the guide plate 55 cooperates with the guide portion 51 to constitute a groove for loosely receiving therein the leg 53, and two nuts 56 and 57 are screwed onto the forward end portion of the pivot 52 to fix the guide plate 55 in position. Furthermore, a hole 58 is formed at the lower end of the lifting member 5*b*, and a coil spring 59 having a weak resilient force is confined between the top end face of the leg 53 and this hole 58. The normal positional relationship between the lifting member 5*b* and the fabric presser foot 5*a* is as shown in FIG. 4. If the lifting member 5*b* is lowered to the maximum from this state through the action of the air cylinder E2, then the fabric presser foot 5*a* engages the top surface of the bench 1. The fabric presser foot 5*a* slightly upwardly moves relative to the lifting member 5*b* against the coil spring 59, whereby the fabric presser foot 5*a* constantly, slightly, pressingly holds the piping fabric P onto the wearing material W during sewing irrespective of a change in thickness of the piping fabric, so that the piping fabric P can be prevented from flapping due to the friction with needles 8 and 8 when the needles stick into and are drawn from the piping fabric P. Additionally, the fabric presser foot 5*a* is vertically, penetratingly provided at the forward end portion thereof with needle holes 29 and 29, which are opened in the direction of transferring the fabrics and opposed to the needles 8 and 8 of the sewing machine 2. In addition, as for the details of a driving mechanism for the lifting member 5*b*, reference is to be made to the specification and the drawings of Japanese patent application No. 69129/78.

The bench 1 is vertically, penetratingly provided in the rear of the sewing machine 2 with a groove 10 disposed in the direction of transferring the fabrics. Further, a guide shaft 11 and a screw shaft 12 are supported along the groove 10 on the undersurface of the bench 1, and the screw shaft 12 is interlocked with a pulse motor (transfer motor) M2 and is rotated in the normal or reverse direction.

The fabric transfer mechanism 3 comprises: a transfer bed 13 supported at the lower portion thereof on the screw shaft 12 and the guide shaft 11, and interlocked with the rotation of the screw shaft 12 to be movable in the axial line thereof; a pair of clamp arms 15 and 15 supported on the upper portion of the transfer bed 13 through a shaft 14, constantly, upwardly drawn through the resiliency of a spring, not shown, and pushed downwardly through the action of an air cylinder E1 (not shown); wearing material pressers 16 and 16 affixed to free ends of the both clamp arms 15; support plates 17 and 17 fixedly provided, being spaced apart upwardly from the wearing material pressers 16 and 16;

piping fabric pressers 4 and 4 each interposed between the wearing material presser 16 and the support plate 17, constantly, resiliently held at positions indicated by two-dot chain lines in FIG. 2 through the resiliency of springs, and made movable to positions indicated by solid lines through the action of an air cylinder E3 (not shown); and flap fabric pressers 18 and 18 constantly, resiliently held at positions indicated by two-dot chain lines in FIG. 2 through the resiliency of springs and capable of being pushed to positions indicated by solid lines in FIG. 2 through the action of air cylinders E4 and E4 (Refer to Fig.).

The fabric transfer mechanism 3 and the folding mechanism 5 are associated in operation as follows. The wearing material W is inserted between the undersurface of the wearing material pressers 16 and 16 and the top surface of the bench 1 at the first position indicated by two-dot chain lines in FIG. 1. A foot pedal 19 (Refer to FIG. 6) depressible through three steps is depressed to the first step, whereby the both clamp arms 15 and 15 are rotated in the clockwise direction in FIG. 1 against the springs through the action of the air cylinder E1. By this, this wearing material pressers 16 and 16 are lowered to push the wearing material W. Subsequently, the piping fabric P is inserted in such a manner that the central portion thereof is positioned between the inner edges of the wearing material pressers 16 and 16 and the foot pedal 19 is depressed to the second step, whereby the fabric presser foot 5*a* of the folding mechanism 5 is lowered into a space between the wearing material pressers 16 and 16 as indicated by two-dot chain lines from a position indicated by solid lines in FIG. 1 through the action of the air cylinder E2 to push the central portion of the piping fabric P onto the wearing material W. Thereafter, the respective piping fabric pressers 4 and 4 are transferred to a position indicated by solid lines in FIG. 2 through the action of the air cylinder E3, and opposite side portions of the piping fabric P are folded around the fabric presser foot 5*a* into an inverted T-shape. Subsequently, when the flap fabric F is to be sewn, the flap fabric F is rested on one of the support plates 17 in such a manner that the end edge thereof to be stitched is positioned on one of the folded portions of the aforesaid piping fabric P. Then, the foot pedal 19 is depressed to the third step, whereby the flap fabric pressers 18 and 18 are rotated to positions indicated by solid lines in FIG. 2 through the action of the air cylinders E4 and E4 to push the flap fabric F onto the folded portion of the piping fabric P.

As shown in FIG. 1, the flap fabric pressers 18 and 18 are each vertically, penetratingly provided therein with an elongate slot 20 in parallel to the direction of transferring the fabrics. The top surfaces of the piping fabric pressers 4 and 4 opposed to the total lengths of these slots 20 and 20 are formed into surfaces of reflection. On a jaw portion of the sewing machine 2 at the upstream side of the sew-up point of the sewing machine 2 in the direction of transferring the fabrics, there are provided a pair of fabric end detecting means 21 and 21 each comprising a light emitting element for irradiating a light toward the aforesaid slot 20 from above in the set state as indicated by solid lines in FIG. 2 at the positions indicated by two-dot chain lines in FIG. 1 and a light receiving element for receiving a light reflected by the surface of reflection of the piping fabric presser 4. Furthermore, on the upper surfaces of the support plates 17 and 17, there are provided positioning means 22 and 22 for instructing or regulating the position of the rear end (to the right in FIG. 1) of the flap fabric F, so that the sewing machine 2 can stop upon passage of the rear end of the flap fabric F through the sew-up point of the sewing machine 2.

(II) Regarding the control panel

Figure 5:
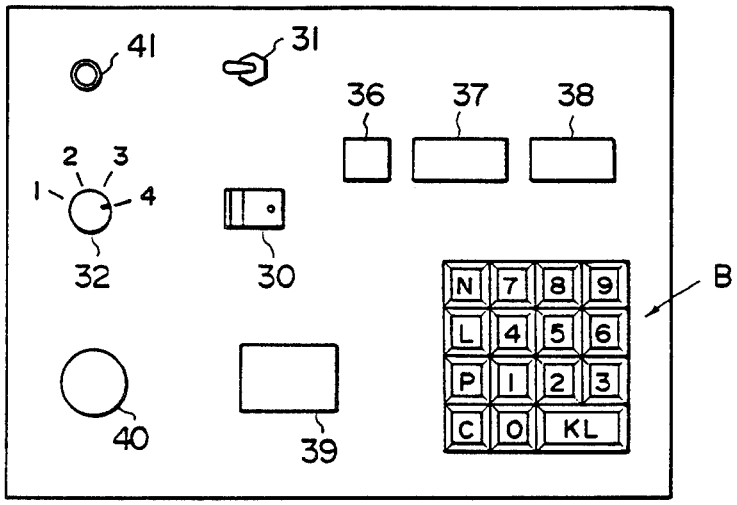
FIG. 5 is a front view showing a control panel.

In FIG. 5, designated at 30 is a mode changeover switch for making "a single mode" or "a continuous mode" selectable. Denoted at 31 is a stacker changeover switch for making operation of the stacker or non-operation of the stacker selectable in association with the completion of sewing. Indicated at 32 is an action changeover switch for making indexes selectable through four steps in such a manner that, the index "1" is selected when only the fabric transfer mechanism 3 is operated. The index "2" is selected when the fabric transfer mechanism 3, the sewing machine 2 and a yarn cutting mechanism are to be operated. Further, the index "3" is selected when the center knife is to be additionally operated, and the index "4" is selected when all of the mechanisms including the corner knives are to be operated. Designated at B are a plurality of press buttons, which select respective data to be described hereunder in accordance with the combination of the pressing orders of the respective keys and the mode selected by the mode changeover switch 30. However, only a key "KL" alternates between "ON" and "OFF" each time it is pressed.

Denoted at 36, 37 and 38 are indication windows in which the pattern number, the dimension of seam and the number of materials to be sewn are indicated when they are inputted and outputted, and indicated at 41 is an indication lamp which is turned "ON" while the key "KL" is "ON".

Designated at 39 is a start switch, and 40 an emergency stop switch to be closed when pressed, and opened when released.

(III) Regarding a control circuit

As shown in FIG. 6, connected to an input section 33 of a microcomputer (hereinafter referred to as "MC") comprising a Central Processing Unit (hereinafter referred to as "CPU"), a Read Only Memory (hereinafter referred to as "ROM") and a Random Access Memory (hereinafter referred to as "RAM") are output sections of the mode changeover switch 30, the stacker changeover switch 31, the action changeover switch 32, the press button switches B, the foot pedal 19, the fabric end detecting means 21 and a microswitch 34 disposed in the moving path of the transfer bed 13 beneath the bench 1 for detecting the first position (the original point) and the second position of the fabric transfer mechanism 3. Additionally, connected to an output section 35 of MC is an input section of a solenoid valve V for controlling a machine motor M1, a transfer (or stepping) motor M2 and the air cylinders E1 through E4 (not shown).

The transfer (or stepping) motor M2 receives driving pulses from an oscillator circuit, not shown, and rotates in either normal or reverse direction, whereby the fabric presser portion of the fabric transfer mechanism 3 is moved between the first position indicated by the two-dot chain lines in FIG. 1 and the second position indicated by the solid lines in the same drawing as above by the instructions from CPU (the distance therebetween being about 345 mm), so that the transfer bed 13 can be controlled to move a predetermined distance so as to avoid an adverse influence of an inertial force of the stopping transfer motor M2 after the transfer bed 13 is engaged with the microswitch 34 disposed at the other side in the moving direction of the transfer bed 13.

The machine motor M1 is adapted to stop at the time when the fabric transfer mechanism 3 has moved a distance of 230 mm from the first position by the instruction of CPU, and has two starting points different from each other depending on whether the output condition of MC is either "a binding mode" or "a flap sewing mode". In the case of the former, the fabric transfer mechanism 3 is adapted to start from the time when the fabric transfer mechanism has moved a distance of a difference between 280 mm and a dimension of seam, and in the case of the latter, the fabric transfer mechanism 3 is adapted to start at the time when the fabric transfer mechanism 3 has moved a distance between the needles 8 and the fabric end detecting means 21 after the forward end of the flap fabric F is detected by the fabric end detecting means 21.

(IV) Regarding a key input of the single mode

Under the condition of the single mode being selected, the mode changeover switch 30 is programmed such that "the key input processing of the single mode" to be described hereunder is performed.

Firstly, the "KL" key is turned "OFF", or "N" key among the press button keys B is pressed, and thereafter, if a key of "0–9" is pressed, then a pattern number corresponding to the number assigned to the key is selected to be indicated in the indication window 36. After the pattern number is selected through the above-described operation, if any one of keys of "0–9" is suitably pressed upon pressing an "L" key, then a dimension of seam corresponding to the pattern number is selected to be indicated in the indication window 37, and subsequently, if the "KL" key is turned "ON", then the data is recorded in RAM. For example, if keys of "N.0", "L.1.0.0" and "KL" are pressed in the order described, then the the data indicating "the dimension of seam of the pattern number 0 is 100 mm" is recorded in RAM.

In addition, the pattern number "9" is of "the flap sewing mode". Since a signal from the fabric end detecting means 21 has priority during the sewing based on this pattern number "9", specifying the dimension of seam is meaningless, and consequently, substantially stating, as many as nine dimensions of seam for the pattern numbers "0–8" can be previously recorded in RAM.

The foregoing description is of the write-in of data into RAM, and the read-out of the data is performed such that, after the "KL" key is turned "OFF" again and the "N" key is pressed, if any one of the keys of "0–9" is selected to be pressed, then the pattern number corresponding to the number assigned to the key and the data thereof are selected from ROM and indicated in the indication windows 36 and 37, and subsequently, if the "KL" key is turned "ON", then the data is set. Furthermore, after the above-described pattern number is selected and a "P" key is pressed, if any one of keys of "0–9" is suitably pressed, the number of materials to be sewn is indicated in the indication window 38, and the data indicating that "when the specified number of materials of the specified pattern has been sewn up, the sequence of the device is to be stopped" is recorded in RAM. For example, after the "KL" key is turned "OFF" and the keys are pressed in the order of "N.0" and "P.5.0.0", then the data indicating "the dimension of seam is 100 mm" and "the number of materials to be sewn is 500" are set. In addition, if a "C" key is pressed at the time when sewing of the specified number of materials has been completed, the specified number of materials to be sewn as described above is set again.

(V) Regarding a key input of the continuous mode

Figures 8, 8B:
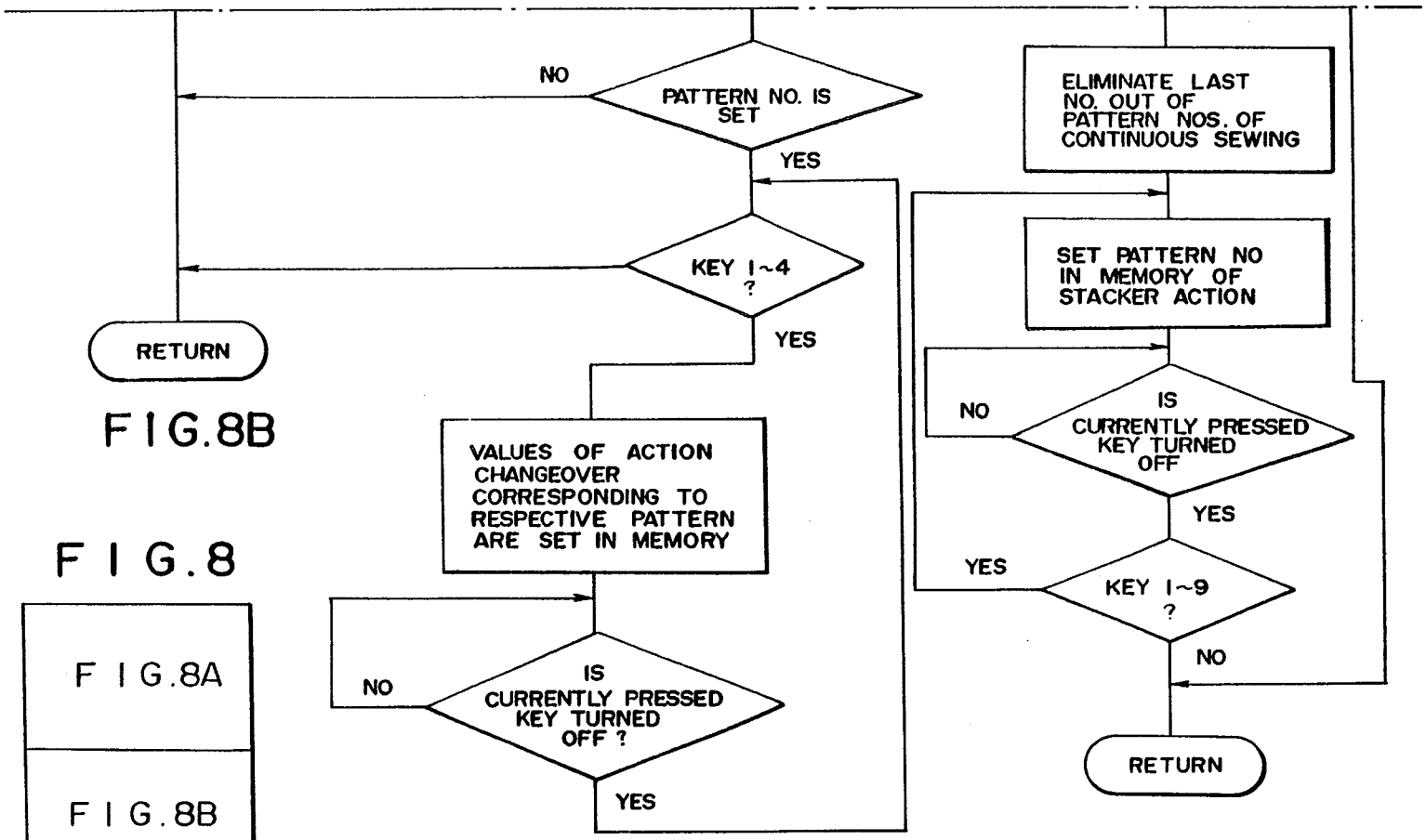
Figure 8A:
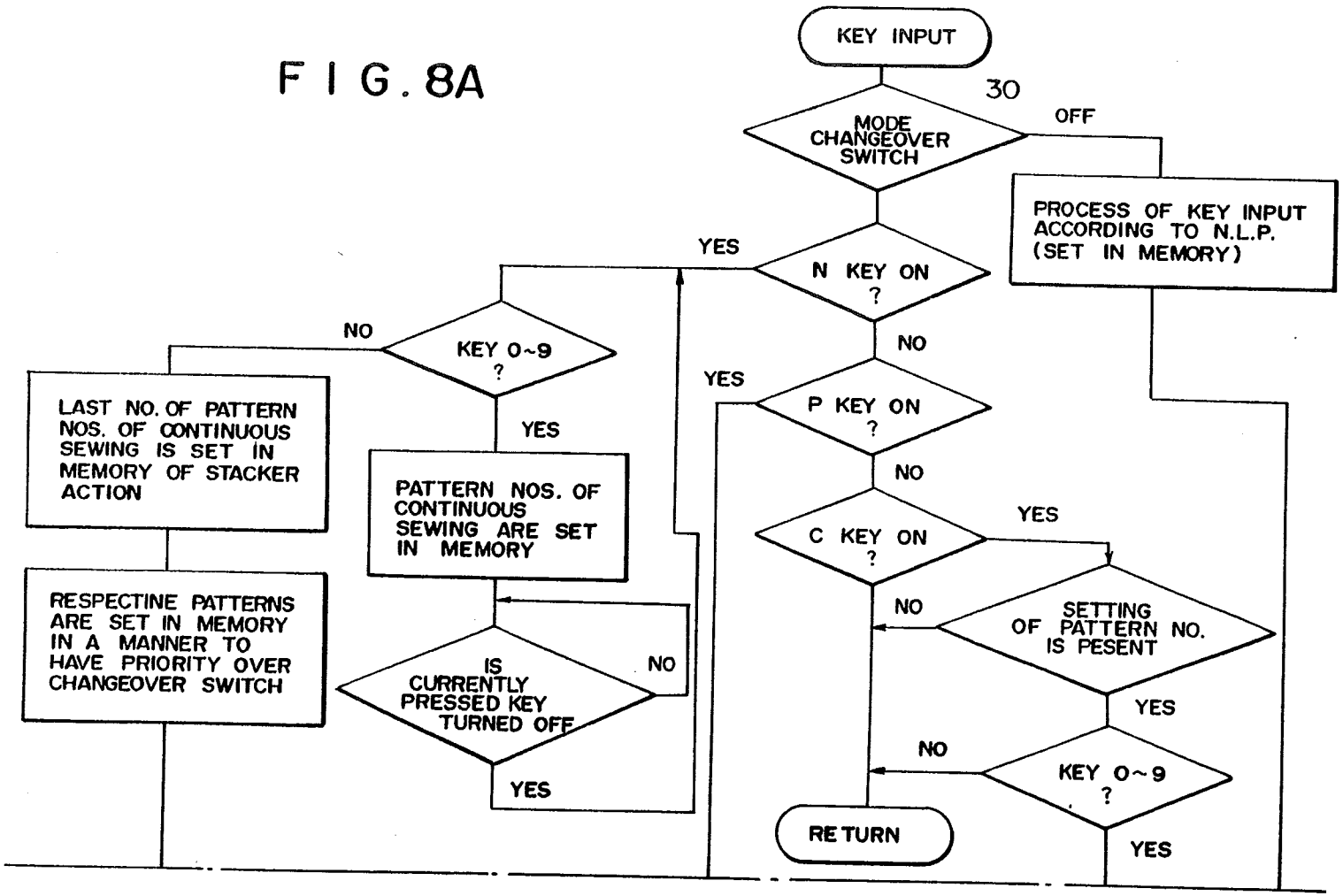

Under the condition of the continuous mode being selected, the mode changeover switch 30 is programmed such that "key input processing of the continuous mode" as shown in FIG. 8 is performed.

Firstly, assumption is made that, for the pattern numbers "0–8" (of the binding mode), there are previously set the dimensions of seam from 100 mm to 190 mm with the differences therebetween being 10 mm. If the keys of the press buttons B are pressed in the order of "N.0.2.4" and "KL" after the "KL" key is turned "OFF", then the pattern numbers are set in the order of "0.2.4" and the pattern number "4", which is finally selected, is set in the memory (RAM) of the stacker action. Furthermore, if the keys are pressed in the order of "N.4.2.0.9", then the pattern numbers are set in the order of "4.2.0.9", and likewise, the pattern number "9", which is finally selected, is recorded in the memory of the stacker action. In the case of the former, according to the above-described setting, the binding of the dimensions of seam of "100 mm", "120 mm" and "140 mm" is repeated, and, in the case of the latter, series of both the binding of the dimensions of seam of "140 mm", "120 mm" and "100 mm" and the flap sewing of the dimensions of seam of "140 mm", "120 mm" and "100 mm" are repeated. In addition, as for the operations of the device at the respective selected pattern numbers, the selected states of the action changeover switch 32 are recorded in the memory as they are.

If any one of the keys "1–4" is selected and the "KL" key is turned "ON" after the "P" key of the press buttons B is pressed, then the selected state of the action changeover switch 32 corresponding to the number is recorded in RAM. For example, if the keys are pressed in the order of "P.4", the data indicating that "the device as a whole is operated" is recorded for the respective patterns, and the data has priority over the subsequent state of the action changeover switch 32.

If any one of the keys "0–9" is selected and the "KL" key is turned "ON" after the "C" key of the press buttons B is pressed, then the number is recorded in the memory of the stacker action in place of the final pattern number of the series of sewings, which has been selected before.

(VI) Regarding the binding of the single mode

Figure 7:
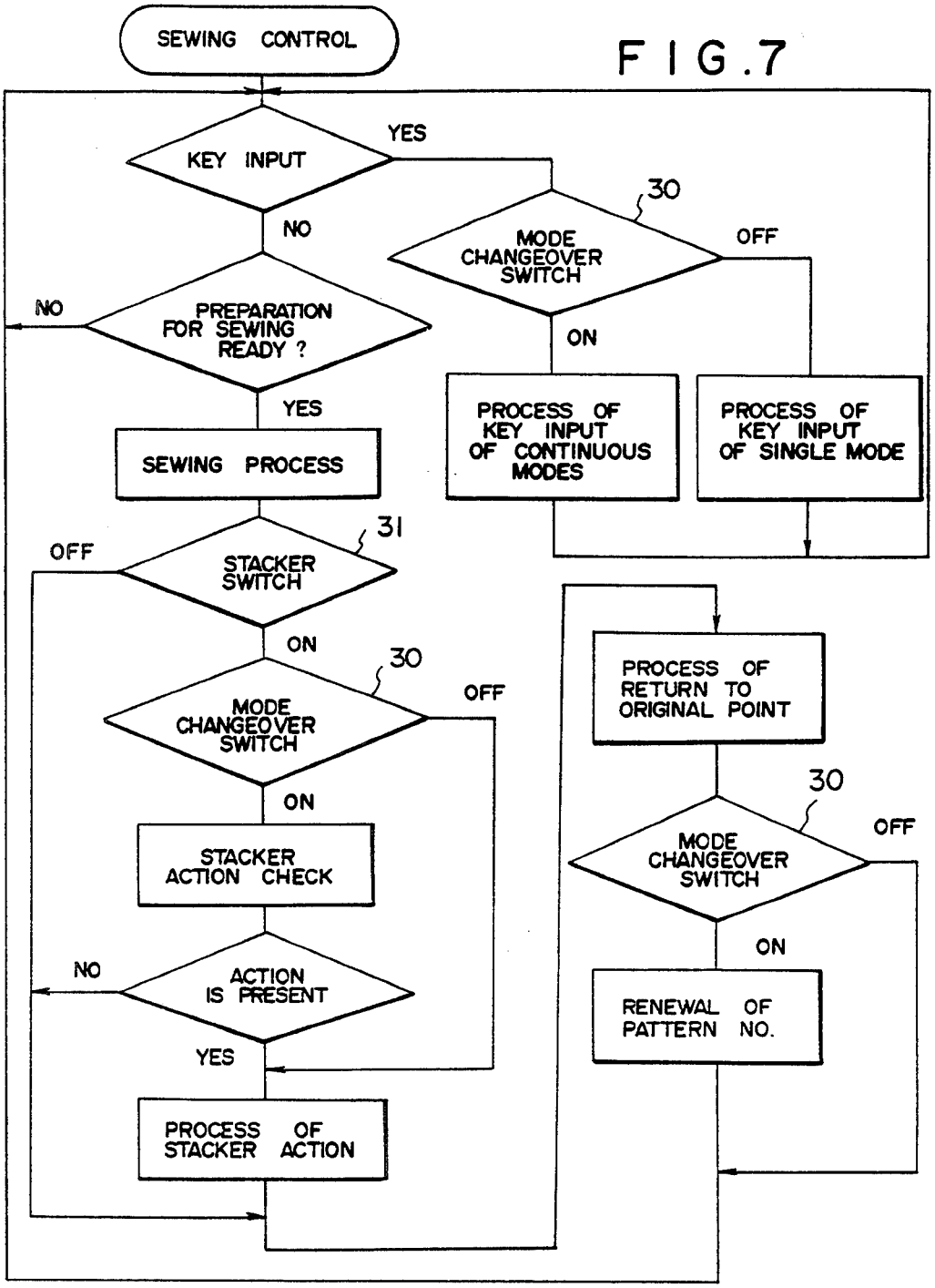
FIG. 7 is a flow chart showing the general arrangement of the sewing device.

If the mode changeover switch 30 is at the selected state of "the single mode" as shown in FIG. 7, then, by the key input processing of the single mode, nine dimensions of seam at the maximum are recorded in RAM. Under this condition of "the single mode", either "the binding mode" or "the flap sewing mode" is selected depending on whether the key "N.9" is selected after the "KL" key is turned "OFF" or the key "N.0–8" is selected after the "KL" key is turned "OFF". Also, in "the binding mode", only one pattern number can be selected from the keys "0–8", and therefore, sewing of the pattern number or numbers cannot be performed unless the key or keys are reselected.

Now, selection of one pattern number (the binding mode) out of "0–8" and turn "ON" of the "KL" key in "the single mode" are judged as "The preparation for sewing is ready", and "the sewing process" is performed in the following manner.

Firstly, the fabric transfer mechanism 3 normally stands by at the first position indicated by the two-dot chain lines in FIG. 1. In this position, the pedal 19 is successively depressed through the three steps to set the wearing material W and the piping fabric P as indicated by solid lines in FIG. 2. Thereafter, if the start switch 39 is turned "ON", then the transfer motor M2, receiving the pulses from the oscillator circuit, starts, whereby the fabric transfer mechanism 3 moves to the left in FIG. 1, so that the piping fabric P being maintained in the folded state in FIGS. 2 and 3 through the agency of the piping fabric pressers 4 and 4 moves together with the wearing material W on the top surface of the bench 1 to be drawn from the fabric presser foot 5*a* of the folding mechanism 5. The machine motor M1 (the sewing machine 2) starts at the time when the fabric transfer mechanism 3 has moved a distance equal to a difference (for example, 130 mm) between the distance (230 mm) from the first position to the point where the sewing machine 2 is stopped and the dimension of seam presently set (for example, 100 mm) according to the calculation of CPU. Then the machine motor M1 (the sewing machine 2) stops at the time when the fabric transfer mechanism 3 has further moved a distance of 100 mm after the machine motor M1 has started in response to an instruction from CPU. However, the transfer motor M2 continues rotating, moves a predetermined distance after the transfer bed 13 of the fabric transfer mechanism 3 is engaged with the microswitch 34, and then, stops at the second position.

Then, if there is present a selected state where all of the mechanisms can be operated by the action change-over switch 32, a yarn cutting mechanism operates immediately before the stop of the sewing machine 2, the corner knife mechanism works in operational association with the movement of the fabric transfer mechanism 3 to the second position, and then, the transfer motor M2 is reversed in rotation to return the fabric transfer mechanism 3 to the first position. Additionally, if the stacker switch 31 is "ON", the stacker operates. When the start switch 39 is turned "ON" again, the pipings having the same dimension are repeatedly formed.

(VII) Regarding the flap sewing of the single mode

In the single mode, if the "KL" key is turned "ON" after the pattern number "9" (the flap sewing mode) is reselected, then "the sewing process" is performed in the following manner.

Firstly, if the start switch 39 is turned "ON" after the pedal 19 is successively depressed through the three steps to set the wearing material W, the piping fabric P and the flap fabric F as indicated by solid lines in FIG. 2, then the transfer motor M2 starts and moves the fabric transfer mechanism 3 to the left in FIG. 1. Assuming that the length of the flap fabric F is 100 mm, at the time when the fabric transfer mechanism 3 has moved a distance of 180 mm (Actually, the time is made earlier by a distance from the needles 8 to the fabric end detecting means 21, however, in this case, the above-mentioned distance is regarded as zero for the sake of simplifying the explanation), the light receiving elements of the fabric end detecting means 21 are brought into the light shielded state, and, in operational association therewith, the machine motor M1 (the sewing machine 2) starts. At the time when the fabric transfer mechanism 3 is further moved a distance of 100 mm after the start of the machine motor M1, the aforesaid light receiving elements are brought into the light receiving state, and, in operational association therewith, the machine motor M1 stops. In the same manner as described above, the fabric transfer mechanism 3 further moves to the second position, returns to the first position therefrom, and the yarn cutting mechanism, the corner knife mechanism and the stacker mechanism are controlled to be operated or not operated at respective times in accordance with the selected states of the action changeover switch 32 and the stacker switch 31. If the start switch 39 is turned "ON" again, then the binding is repeated. In this case, the length of seam is determined commensurate to the flap fabric F thus set.

(VIII) Regarding the sewing of the continuous mode

The following operation will be performed when the pattern numbers of the continuous sewing are selected to be set in the order of "4.2.0.9" as described in the key input of the program mode after the dimensions of seam of "0–8" as described in the key input of the single mode (A dimension of seam may be set for only the pattern number used as a first step).

Figure 9:
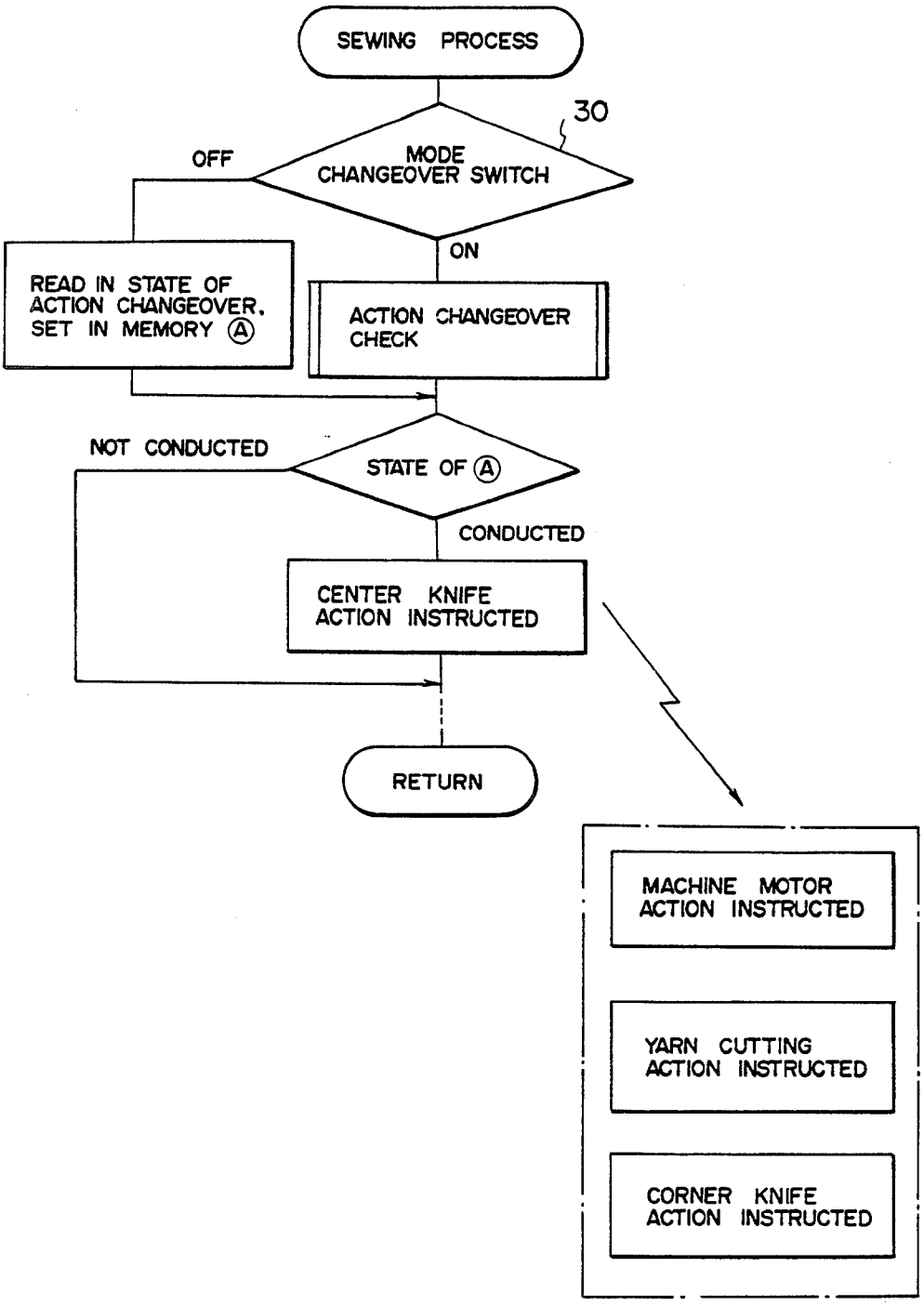

Firstly, if the start switch 39 is turned "ON" after the pedal 19 is successively depressed to set the wearing material W and the piping fabric P, then the machine motor M1 starts at the time when the fabric transfer mechanism 3 has moved a distance of 90 mm from the first position. It then stops at the time when the fabric transfer mechanism 3 has further moved a distance of 140 mm therefrom. The fabric transfer mechanism 3 further moves to the second position, then, returns to the first position, and, in operational association therewith, the pattern number is changed to "2" from "4". In this case, operations of the yarn cutting mechanism and the corner knife mechanism are controlled in accordance with the action changeover memory and the selected state of the action change-over switch 32 as shown in FIGS. 9 and 10.

Likewise, each time the fabric transfer mechanism 3 returns to the first position, the pattern numbers are renewed one after another, and, if the start switch 39 is turned "ON", then the binding corresponding to the changed pattern number "2" or "0" is performed. Subsequently, if the pattern number is changed to the final "9", then the output from MC is changed to be "the flap sewing mode". Therefore, if the pedal 19 is depressed to set the wearing material W, the piping fabric P and the flap fabric F and the start switch 39 is turned "ON", then the times of the start of sewing and the end of sewing of the sewing machine 2 can be controlled as described in "the binding of the single mode", and, if the stacker switch 31 is "ON", the fabric transfer mechanism 3 moves to the second position, where the corner knives operate. Thereafter, the stacker operates, and, when the fabric transfer mechanism 3 returns to the first position, the pattern number is changed to the initial "4" again, whereby the patterns of "4", "2", "0" and "9" are repeated.

Even when a trouble such as a broken yarn occurs and the fabric transfer mechanism 3 is automatically stopped in an emergency situation before it returns to the first position (on the way of a sewing cycle) or the emergency stop switch 40 is manually pressed to stop the device, if the fabric transfer mechanism 3 is returned to the first position after the cause of the trouble is removed, the pattern number remains unchanged, and consequently, if the start switch 39 is turned "ON", then the sewing of the same pattern number can be performed again.

When the number of sewings preset by the "P" key is terminated at a pattern number on the way of continuous sewings, the pattern number can be changed in operational association with the return of the fabric transfer mechanism 3 to the first position.

(IX) Regarding another embodiment

FIG. 11 shows another embodiment in which the program of ROM of the preceding embodiment is diagrammatized. The pattern number "9" represents "the single mode of the flap sewing mode", the pattern numbers "0–3" represent "the single modes of the binding mode", the pattern numbers "4–5" and "6–8" represent two types of "the continuous modes of the binding mode" which are independent of each other, the dimensions of seam of the respective pattern numbers "0–8" are made recordable in RAM shown in FIG. 6 by "the key input processing of the single mode" in the preceding embodiment, and thereafter, a desirable pattern number can be selected and set.

If any one of the pattern numbers "0–8" is selected and set, the piping having a dimension of seam previously inputted corresponding to the pattern number can be formed.

If the pattern number "4" is set, then, each time the fabric transfer mechanism 3 returns to the first position upon completion of the sewing corresponding to the pattern number "4", then the pattern number is changed, and, each time the device is driven, the bindings corresponding to the pattern numbers "4" and "5" are repeated, and, likewise, if the pattern number "6" is set, then, the bindings corresponding to the pattern numbers "6" through "8" are repeated.

Further, if the pattern number "9" is set, then the detection signal of the fabric end detecting means 21 becomes effective, so that the flap sewing having a desirable length can be performed.

In the control circuit of this embodiment, only the mode changeover switch 30 of the preceding embodiment becomes unnecessary, with other components being similar to those shown in FIG. 6.

In consequence, in the flow chart shown in FIG. 6, only "the key input processing of the continuous mode" is eliminated, with other components being identical with those of the preceding embodiment.

In addition, another embodiment described in this item merely illustrates an example. In FIG. 11, the pattern numbers "4" through "8" may be set in one continuous mode, and the pattern numbers "5–7" and "8–9" may be set in two continuous modes independent of each other. In the case of the latter "8–9" continuous mode, the binding and the flap sewing are alternately repeated.

As has been described hereinabove, according to the present invention, the memory means and the controller are provided, each time the fabric transfer mechanism returns from the second position to the first position the length data stored in the memory means is repeatedly renewed one after another in accordance with the order data, and, during the movement of the fabric transfer mechanism from the first position to the second position, the sewing machine is driven and stopped during the time period suitable for forming the seam lines in accordance with the length data thereof. Hence, the troublesome works of reselecting the length of seam or resetting the fabrics each time one seam is stitched, which would have otherwise been required, can be eliminated. A mere start operation of the sewing device makes it possible that all of the pockets of the body material set are sewn, so that the working efficiency in sewing is improved to a considerable extent. Moreover, once the length of seam is accurately set, there is no need to reset as long as products of the same type are sewn, so that such an accident that the length of seam is mistakenly set, which would have otherwise been seen, can be avoided, thereby enabling to obtain products having uniform lengths of seam required and high value as a commodity.

What is claimed is:

1. A piping sewing device comprising:

a machine motor, a sewing machine associated with said machine motor, said sewing machine having two needles fixedly disposed on a top surface of a bench for forming two substantially parallel seams, a transfer motor being operated in response to pulse signals to be input, a fabric transfer mechanism for holding a fabric, said fabric transfer mechanism being associated with said transfer motor so as to be movable on the surface of said bench to transfer said fabric between a first position and a second position with a machine sewing portion being interposed therebetween, a center knife mechanism operated in association with a sewing operation of said sewing machine for cutting an opening between lines of said two seams, fabric end detecting means arranged for detecting the end of the transferred fabric at a position before said machine sewing portion in a fabric transfer direction of the sewing operation, input means for inputting data, said input means including a plurality of switches to be operated by an operator, first memory means for storing at least one of a plurality of different pattern numbers and length data of the seam lines to be stitched on the fabric in response to an operating mode of said input means, second memory means for storing information for effecting fabric end signals of said fabric end detecting means and its pattern number, selection means including a plurality of manually operated switches, third memory means for reading and storing at least one of a plurality of pattern numbers and the corresponding length data from said first and second memory means and further storing an operation order of said pattern numbers and length data, a counter for counting pulse signals applied to said transfer motor, computing means for computing a time period of drive and stop of said machine motor in connection with the counted value of said counter in accordance with the fabric end signal and the length data, a first control circuit for starting said fabric transfer mechanism from said first position and reciprocally moving the same between said first position and said second position in connection with the starting operation, said first control circuit driving and stopping said machine motor in connection with the computed data as said mechanism moves from said first position to said second position, a second control circuit for cyclically effecting the stored data in said third memory means in accordance with the operating order at every return of said fabric transfer mechanism to the first position in connection with a particular counted value of said counter.

* * * * *